US006374658B1

(12) United States Patent
Gascoin et al.

(10) Patent No.: US 6,374,658 B1
(45) Date of Patent: Apr. 23, 2002

(54) BENDING PRESS WITH SLOTTED LOWER PANEL

(75) Inventors: Eric Gascoin; Olivier Bouchentouf, both of Tours (FR); Koji Shima, Isehara (JP)

(73) Assignees: Amada Europe, Tremblay-en-France (FR); Amada Co., Ltd., Kanagawa (JP)

( * ) Notice: Subject to any disclaimer, the term of this patent is extended or adjusted under 35 U.S.C. 154(b) by 0 days.

(21) Appl. No.: 09/629,896

(22) Filed: Jul. 31, 2000

(30) Foreign Application Priority Data

Aug. 9, 1999 (FR) ..... 99 10315

(51) Int. Cl.[7] ..... B21D 5/01
(52) U.S. Cl. ..... 72/389.5; 72/455; 72/701
(58) Field of Search ..... 72/389.3, 389.4, 72/389.5, 389.6, 701, 455

(56) References Cited

U.S. PATENT DOCUMENTS 4,016,742 A * 4/1977 Shiokawa ..... 72/389.5
5,293,972 A * 3/1994 Krumholz ..... 72/389.3

FOREIGN PATENT DOCUMENTS

| | | |
|---|---|---|
| DE | 2317832 | 10/1974 |
| JP | 2558928 | 1/1998 |
| JP | 2000-343125 | * 12/2000 |
| JP | 2001-121214 | * 5/2001 |

* cited by examiner

*Primary Examiner*—David Jones
(74) *Attorney, Agent, or Firm*—Greenblum & Bernstein P.L.C.

(57) ABSTRACT

This invention relates to a bending press for bending metal foils, comprising a mobile panel and a fixed panel. The fixed panel comprises two slots open on the lateral faces of the lower panel and symmetrical with respect to the transverse median plane of this fixed panel. The bottom of each slot is formed by the inner wall of a through bore made in the lower panel which extends over an angle close to 360°, in order to distribute the stresses due to the bending over a broader area. A safety stop is provided in the opening of each slot in order to limit the vertical displacement of the ends of the upper part of the lower panel.

7 Claims, 5 Drawing Sheets

BENDING PRESS WITH SLOTTED LOWER PANEL

FIELD OF THE INVENTION

The present invention relates to a bending press for bending metal foils, of the type comprising an upper panel disposed above a lower panel, one of these panels being fixed in abutment on its ends while the other panel is mobile and actuated in a vertical plane by drive members likewise located at its two ends, the fixed panel being constituted by a plate comprising an upper part and a lower part defined by two slots symmetrically identical with respect to the median transverse plane of said fixed panel, each slot being defined by an upper wall and a lower wall connected by a bottom, and opening out by an opening on the corresponding lateral edge of said plate.

BACKGROUND OF THE INVENTION

Japanese Utility Model 2 558 928 describes a bending press of this type, in which the work edges of the upper panel and of the lower panel are deformed along longitudinal lines of curvature curved upwardly under the action of the bending efforts exerted by the drive members, and taken up by the end bearings of the lower part of the panel. During the application of the bending efforts, the lateral ends of the upper part approach the lateral ends of the lower part. In other words, the upper walls of the slots approach the lower walls of the slots, and the region of the bottom of the slots is subjected to considerable and repeated stresses which may irremediably degrade the intrinsic elasticity of the upper part of the lower panel.

This Japanese Utility Model also indicates that the slots are each provided with a mobile member of which the position is adjustable, manually or automatically, inside the slots. This mobile member is directly in contact with the lower and upper walls of the corresponding slot and its displacement makes it possible to virtually limit the depth of said slot and therefore to reduce, as the mobile member approaches the opening, the elasticity of the lower panel.

This mobile member makes it possible to adjust the elasticity of the lower panel depending on the bending efforts to be exerted on a workpiece, in order that the lines of curvature of the two work edges of the upper and lower panels be as parallel as possible.

The bottom of each slot is generally constituted by a curved wall whose ends are tangentially connected respectively to the upper wall and to the lower wall. If the latter are substantially parallel, the curved wall is semi-circular, and if they diverge towards the opening, the curved wall is in the form of a sector less than 180°. The stresses in the plate are considerable in the immediate vicinity of this curved connecting surface and stress peaks in this area may bring about an irremediable and irreversible degradation of the elasticity of the upper part of the lower panel. In the absence of mobile member, the stresses in the bottom area are compression stresses . These stresses may be transformed into tensile stresses when the mobile member is placed near the bottom. These tensile stresses may bring about cracks when the radius of curvature of the bottom is small.

It is an object of the present invention to propose a bending press as mentioned hereinabove, which can carry out a very large number of bending operations without risk of irreversible damage.

SUMMARY OF THE INVENTION

This object is attained by the fact that the bottom of each slot is formed by the inner wall of a through bore made in the plate, said inner wall extending over an angle close to 360° in order to distribute the stresses due to the bending over a broader area.

With equal curvature of the bottom, the area subjected to the high stresses of the bending press according to the invention is at least equal to double the high-stress area of present-day bending presses. The punctual stresses are thus reduced and there is less risk of obtaining destructive peaks of punctual stresses. The safety steps limiting the relative displacement of the ends of the upper part with respect to the lower part of the lower panel, the bending forces greater than the nominal forces which bring about abutment of the ends of the upper part on the stops, will not cause additional stresses in the region of the bottom.

According to another characteristic, the plate is reinforced in the region of each bottom by at least one lateral counter-plate presenting a cut-out following the shape of the contour of the bottom and of the slot.

A counter-plate is advantageously arranged on either side of the plate in the region of each bottom.

According to yet another characteristic, a sleeve is fitted tightly in each bore, said sleeve being intended to distribute the bending stresses in the regions of the plate surrounding said bore.

BRIEF DESCRIPTION OF THE DRAWINGS

The invention will be more readily understood on reading the following description given by way of example and with reference to the accompanying drawings, in which.

DESCRIPTION OF PREFERRED EMBODIMENTS

Figure 1:
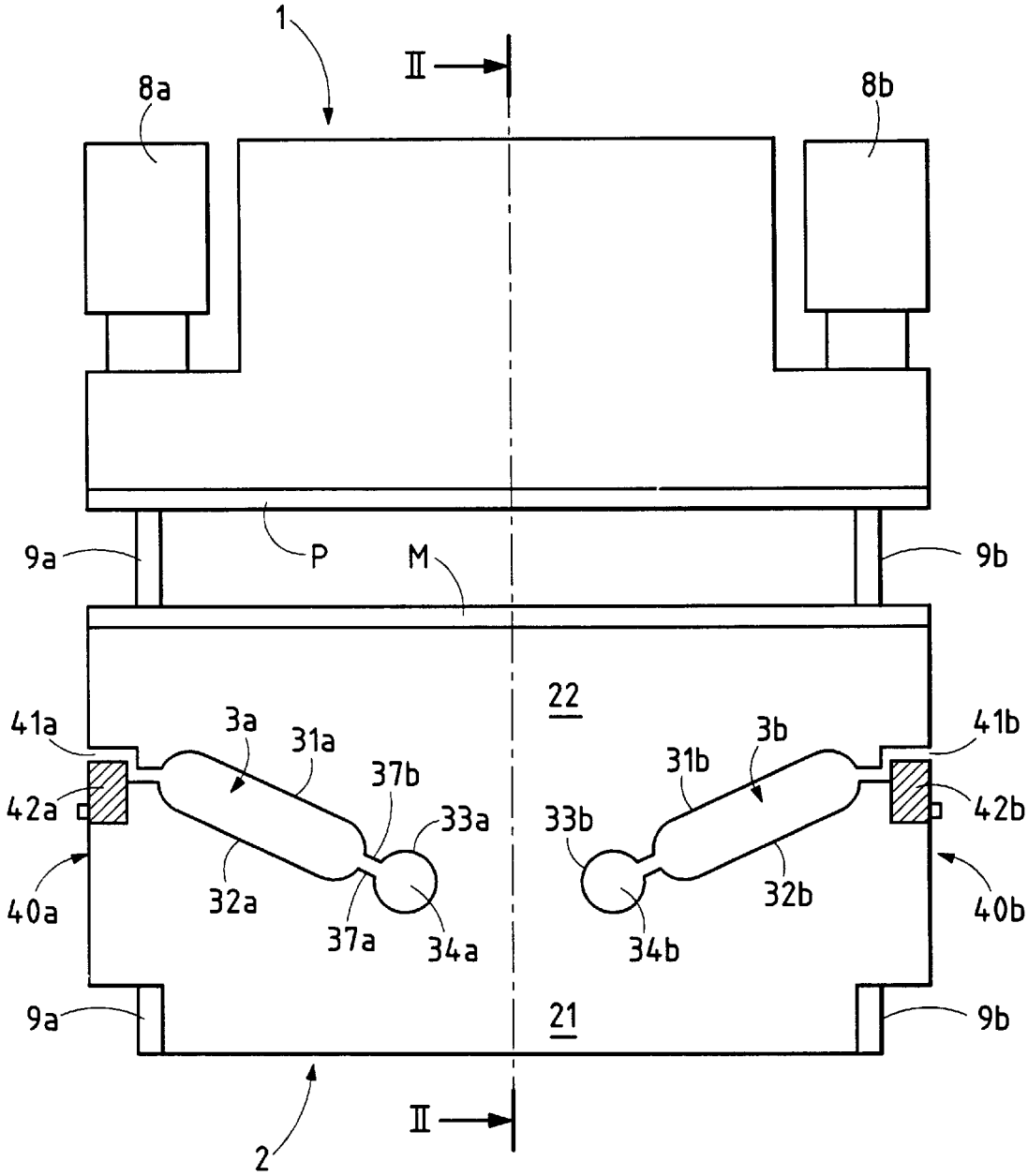
FIG. 1 is a front view of a bending press according to the invention.
Figure 2:
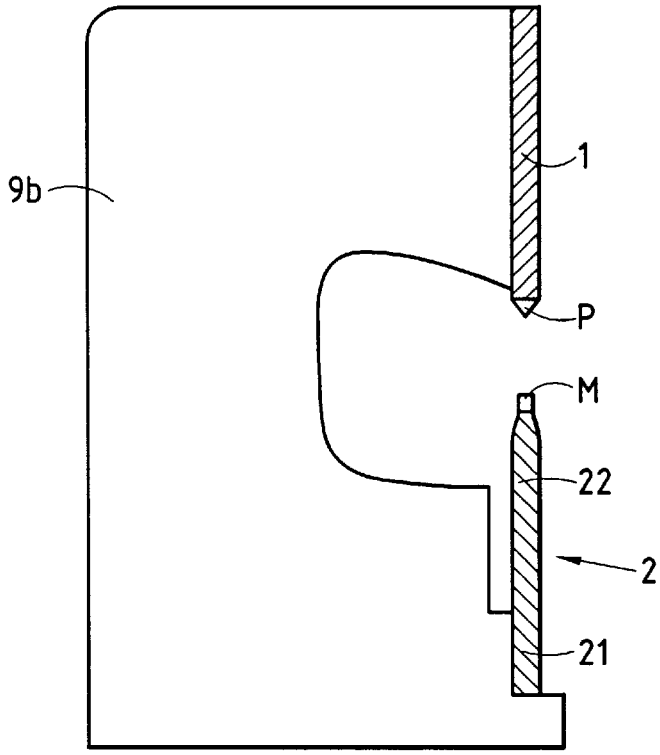
FIG. 2 is a vertical section along line II—II of FIG. 1.

Referring now to the drawings, FIGS. 1 and 2 show a bending press according to the invention.

This bending press comprises an upper panel 1 and a lower panel 2 mounted in a frame formed by two plates 9*a* and 9*b* joined together, in particular by a cross-bracing beam (not shown in the drawings).

The upper (1) and lower (2) panels are contained in the same vertical plane and the upper panel 1 slides with respect to the plates 9*a* and 9*b* with the aid of guiding means 8*a* and 8*b* constituted for example by two hydraulic jacks.

The work edges of these two upper and lower panels respectively bear a bending punch P and a corresponding die M.

The angle of bend of a metal sheet or foil depends on how much the punch P penetrates inside the die M and, consequently, in order to obtain a constant-angle bending over the whole length of the bend, this penetration must be the same over the whole length.

The lower panel 2 is constituted by a plate provided with two slots 3*a* and 3*b* symmetrically identical with respect to the median transverse plane of the lower panel 2, represented in FIG. 1 by the line of section II—II.

Each slot 3*a* and 3*b* extends substantially in an inclined direction starting from the lower median zone of the plate towards the lateral upper end of the plate. Each slot 3*a* and 3*b* is defined by an upper wall 31*a* and 31*b* and a lower wall 32*a* and 32*b* which are substantially parallel to one another, and open out on the lateral face 40*a,* 40*b* of the plate via an opening 41*a,* 41*b* in which is provided a safety stop 42*a,* 42*b* which will be described hereinbelow.

Each slot 3*a* and 3*b* further comprises a bottom 33*a* and 33*b* which connects the upper walls 31*a* and 31*b* and lower walls 32*a* and 32*b* at the level of the central area of the lower panel 2.

The lower panel 2 thus comprises an upper part 22 and a lower part 21 located respectively above and below the two slots 3*a* and 3*b*.

As may be seen in FIG. 2, the lower part 21 of the lower panel 2 is fixed at its ends to the plates 9*a* and 9*b* forming the frame of the bending press. The lower part 21 may be fixed by welding or by any other means.

As for the upper part 22 of the lower panel 2, it is connected to the lower part 21 solely by the central area of the plate lying between the two bottoms 33*a* and 33*b* of said slots 3*a* and 3*b*.

The upper part 22 of the lower panel 2 thus presents a degree of freedom in the vertical plane, whereby its free ends can be displaced vertically with respect to the fixed ends of the lower part 21, when it is subjected to bending efforts, this generating stresses in the plate constituted by the lower panel 2, in particular in the areas adjacent the bottoms 33*a* and 33*b*.

In order to increase the extent of the area adjacent each of the bottoms 33*a* and 33*b,* these latter are each constituted by the inner wall of a through bore 34*a* and 34*b* made in the plate, said inner wall extending over an angle close to 360° and being connected at its ends to two substantially parallel connecting walls 35*a* and 35*b,* spaced at a short distance from each other, directed towards the centre of the bore 34*a* and 34*b* and connected to curved walls 36*a* and 36*b* respectively extending the upper walls 31*a* and 31*b* and lower walls 32*a* and 32*b*.

The diameter of the bore 34*a* and 34*b* is independent of the distance separating the upper walls 31*a* and 31*b* and lower walls 32*a* and 32*b*. This diameter is dimensioned by calculation and optimalized further to measurements made by strain gauges. The bores 34*a* and 34*b* are precision-machined, so that the surface state of their inner wall eliminates any risks of starting a crack.

Figure 3:
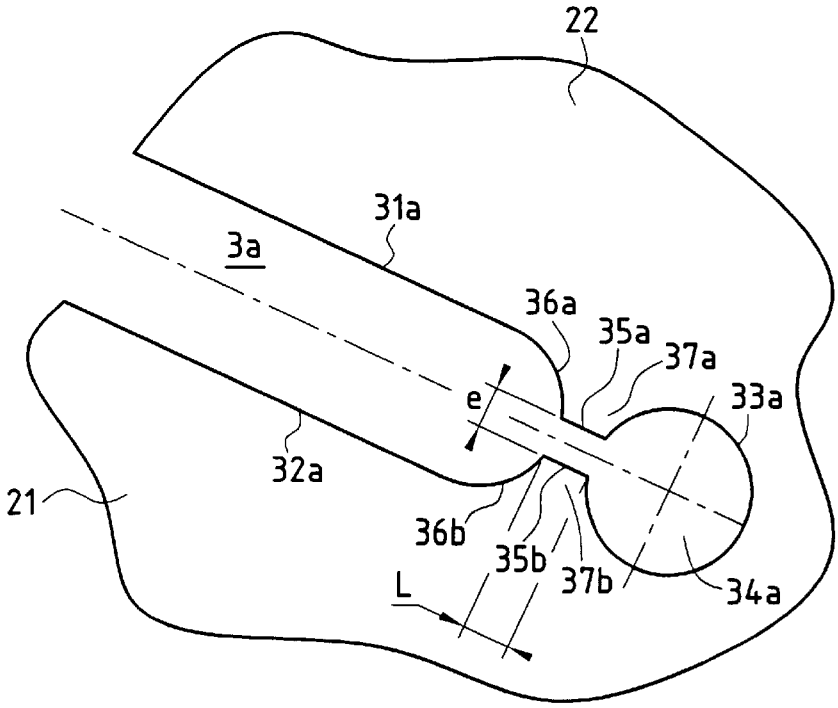
FIG. 3 shows on a larger scale the configuration of the bottom of a slot of the bending press of FIG. 1.

As shown in FIG. 3, the lower part 21 and the upper part 22 of the panel 2 present teeth 37*a* and 37*b,* terminating in connecting walls 35*a,* 35*b* spaced apart by a distance e, and which extend over a length L clearly greater than distance e.

Figure 4:
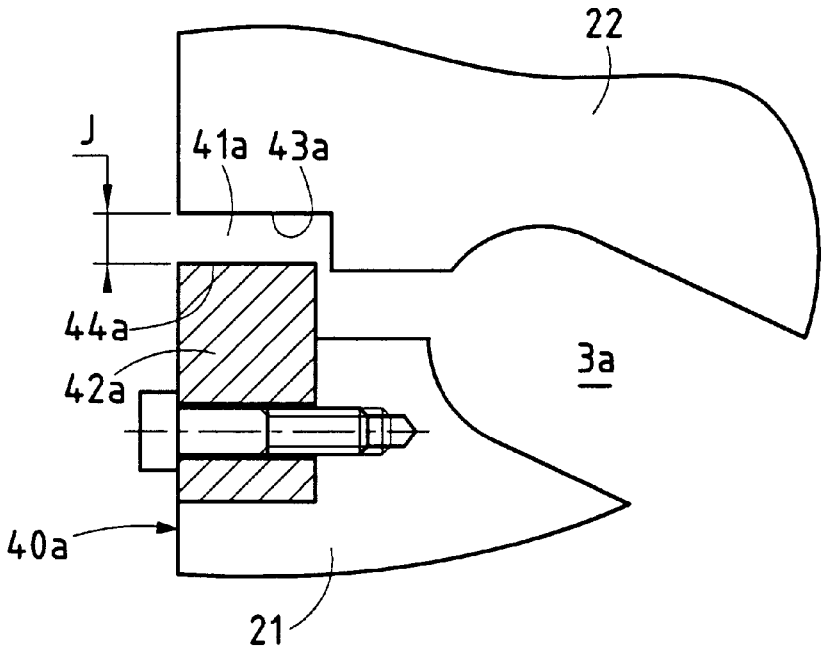
FIG. 4 shows on a larger scale the configuration of the opening of a slot, the bending press being at rest.
Figure 5:
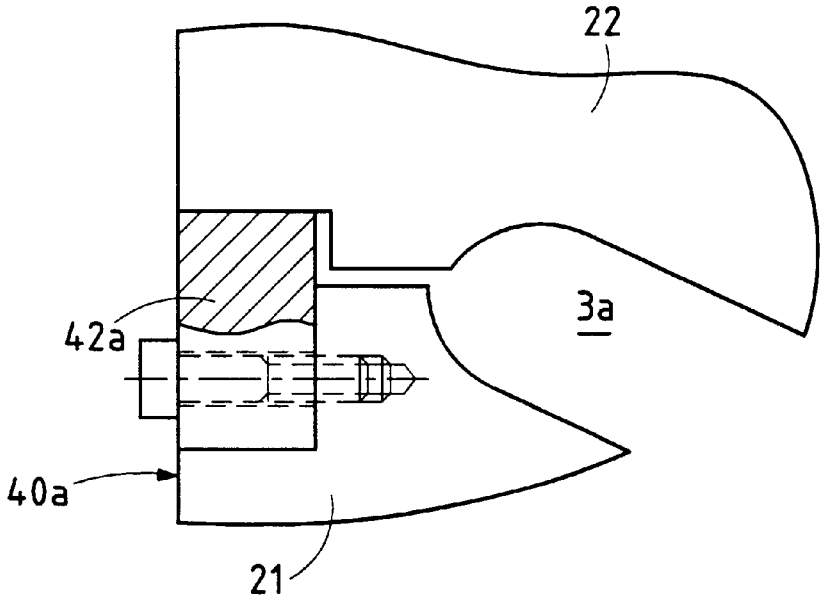
FIG. 5 shows the arrangement of the safety stop when the bending efforts are greater than the nominal force of the bending press.

FIGS. 4 and 5 show the arrangement of the safety stops 42*a* and 42*b* in the openings 41*a* and 41*b* of the slots 3*a* and 3*b*. Each opening 41*a* and 41*b* is defined by the lower face 43*a* of the lateral end of the upper part 22 of the lower panel 2 and by the upper face 44*a* of a safety stop 42*a* and 42*b* fixed in the upper region of the lateral end of the lower part 21 of the lower panel 2. At rest, i.e. in the absence of bending efforts, the faces 43*a* and 44*a* are parallel to each other and spaced apart by a distance J. This distance J decreases when bending efforts are applied and is annulled when the efforts attain the nominal force of the bending press. When the efforts are greater than this nominal force, the stops 42*a* and 42*b* directly transmit the overload to the lower part 21 of the lower panel 2, this limiting the stresses in the regions of the bottoms 33*a* and 33*b* to nominal stress values.

Figure 6:
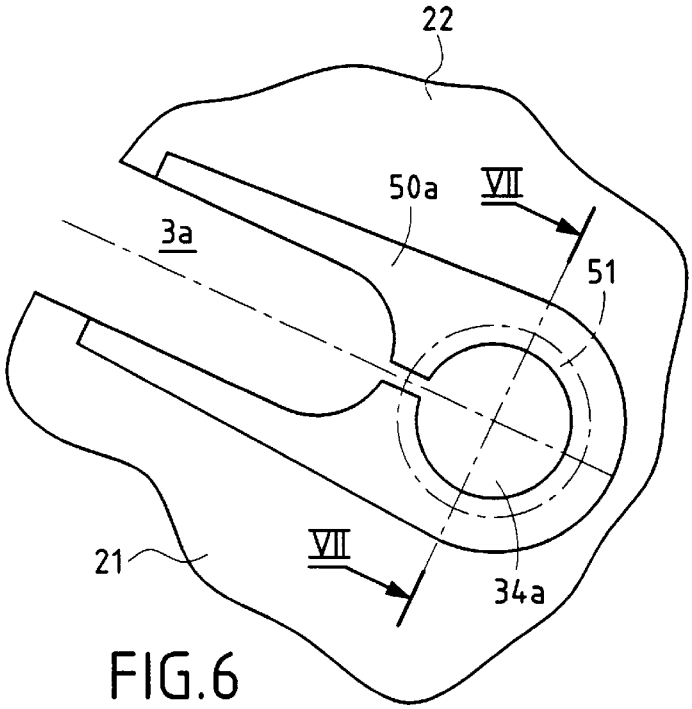
FIG. 6 is a side view of a slot bottom equipped with a counter-plate.
Figure 7:
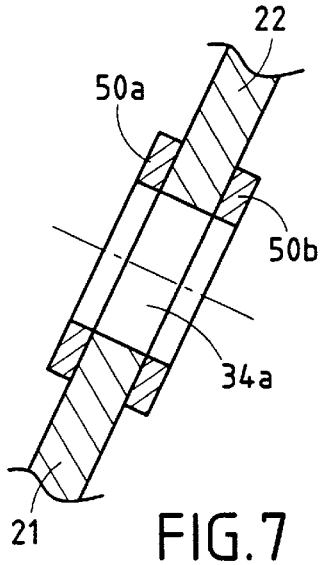
FIG. 7 is a section along line VII—VII of FIG. 6.

In order to distribute the stresses in the regions of bottoms 33*a* and 33*b* over a greater volume of material, reinforcements 50*a* and 50*b* are provided near the bottoms 33*a* and 33*b*. As is shown in FIGS. 6 and 7, these reinforcements 50*a* and 50*b* are in the form of counter-plates arranged on either side of the web of the lower panel 2 and which each present a cut-out following the shape of the contour of the bottoms 33*a* and 33*b* and the slots 3*a* and 3*b*. The counter-plates 50*a* and 50*b* are connected to the web of the lower panel 2 by welding or by any other suitable means. In the case of a weld assembly, the annular area 51, defined by a dashed and dotted line in FIG. 6, does not comprise a weld seam in order to avoid, in this area, tensions due to welding.

Figure 8:
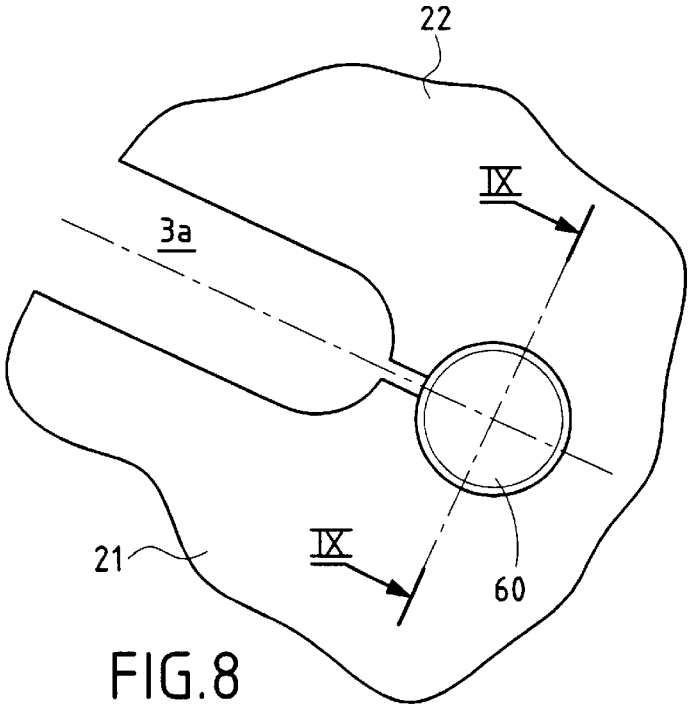
FIG. 8 is a side view of a slot bottom equipped with a stress-distributing sleeve.
Figure 9:
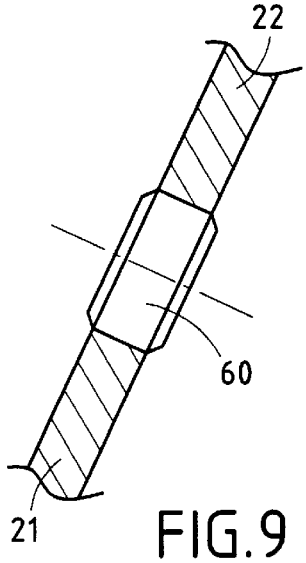
FIGS. 9 and 10 are sections along line IX—IX of FIG. 8.
Figure 10:
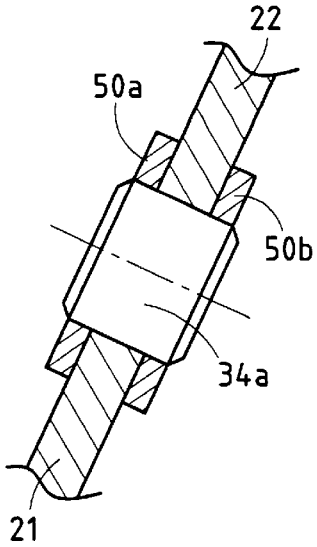

According to another characteristic of the invention, and in order to distribute the stresses more uniformly around the bores 34*a* and 34*b,* a sleeve 60 is fitted tightly in each of these bores, as shown in FIGS. 8 to 10. The sleeve 60 has previously undergone a heat treatment and surface treatment aiming at improving its coefficient of friction, in order to avoid any degradation due to the phenomenon of corrosion of the faces in contact.

Figure 11:
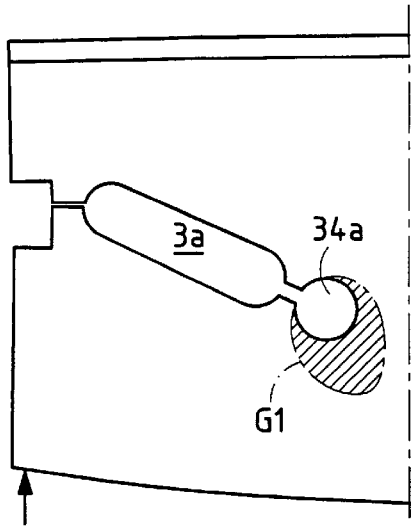
FIG. 11 represents the graph of the stresses around a bottom during a bending operation.
Figure 12:
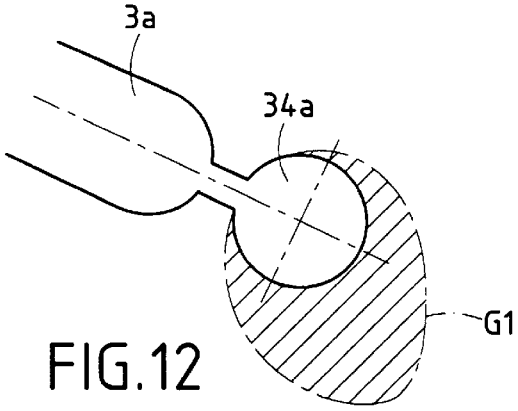
FIG. 12 represents the graph of the stresses on a larger scale.
Figure 13:
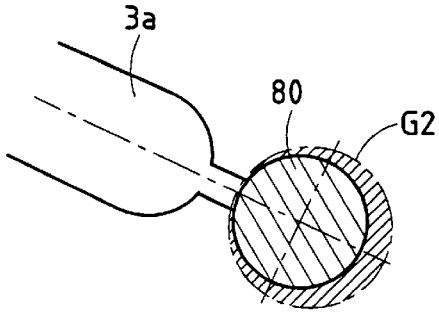
FIG. 13 is similar to FIG. 12 and represents the graph of the stresses when the slot bottom is equipped with a sleeve.

FIGS. 11 and 12 show the graph $G_1$ of the stresses around the bore 34*a* during a bending operation, in the absence of sleeve 60. This graph $G_1$ presents a considerable stress peak. FIG. 13 shows the graph $G_2$ of the stresses when the bore 34*a* comprises a sleeve 60.

The sleeve 60 may be solid or hollow in section. Where the web of the lower panel 2 is reinforced by counter-plates 50*a* and 50*b,* the sleeve 60 is fitted both in the bore 34*a* and 34*b* and in the corresponding openings of the counter-plates 50*a* and 50*b*.

The sleeve 60 shown in FIGS. 9 and 10 is cylindrical and presents a diameter adapted to that of the bores 34*a* and 34*b*. However, the difference in precision of the diameter of the bores 34*a* and 34*b* and of the diameter of the sleeve 60 may affect the precision of the bending.

In order to overcome this situation, the sleeve 60 may be inserted cold. However, this operation would involve an increase in the cost price, due to the more complex machining of the panel.

Figure 14:
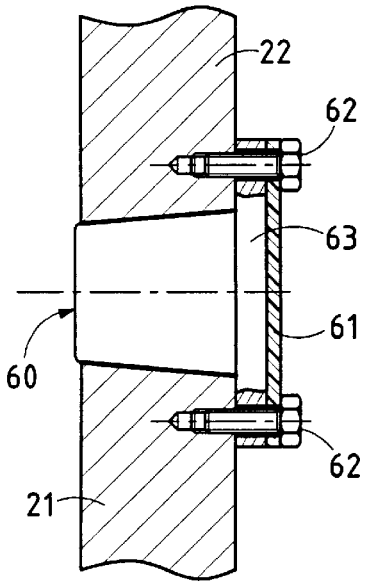
FIG. 14 shows a variant embodiment of the stress-distributing sleeve.

FIG. 14 shows a variant embodiment of the sleeve 60. The bores 34*a,* 34*b* and the sleeve 60 are machined so that they present a conical shape with the same inclination.

The sleeve 60 is maintained in its bore by a plate 61 fixed by bolts 62 on a face of the panel around the largest opening of the bore. A small plate 63 made of elastic material, such as polyurethane, is interposed between the plate 61 and the end face of the sleeve 60. This small plate 63 made of elastic material further enables the clearance between the sleeve 60 and the inner wall of the bore to be eliminated.

In the embodiments described hereinabove, the lower panel is fixed and the upper panel is mobile. The invention is not limited to these embodiments and relates equally well to bending presses in which the upper panel is fixed and the lower panel is mobile. In that case, the slots 3*a* and 3*b* are made in the fixed upper panel.

What is claimed is:

1. A bending press for bending metal foils, said bending press comprising:

an upper panel provided above a lower panel, wherein one of said panels is fixed at ends thereof and the other of said panels is mobile in a vertical plane;

drive members provided at ends of the mobile panel that actuate the mobile panel in the vertical plane;

the fixed panel including a plate, said plate including an upper portion and a lower portion separated by two slots symmetrical with respect to a median vertical plane transverse to the vertical plane of the fixed panel, each said slot including an upper wall and a lower wall connected by a bottom portion, and each said slot opening out at an opening on a corresponding lateral edge of said plate;

wherein said bottom portion of each said slot is formed by an inner wall of a through bore in said plate, said inner wall extending over an angle close to 360° in order to distribute bending stresses over a broad area.

2. The bending press according to claim 1, wherein said inner wall of each said bore includes two ends and each said bore includes a center, said upper wall and said lower wall of each said slot are substantially parallel and connected by curved walls to two substantially connecting walls spaced a short distance from each other, said two connecting walls being directed toward said center of said bore and being respectively connected to said ends of said inner wall of said bore.

3. The bending press according to claim 1, further comprising at least one lateral counterplate that reinforces said plate in a region of each said bottom portion, said counterplate including a cut-out having the shape of said bottom portion and of said slot.

4. The bending press according to claim 3, wherein a counterplate is provided on each side of said plate in the region of each said bottom portion.

5. The bending press according to claim 1, including a sleeve fitted tightly in each said bore, said sleeves distributing bending stresses in the regions of said plate surrounding each said bore.

6. The bending press according to claim 5, wherein each said sleeve and each said bore are formed in a conical shape having the same inclination.

7. The bending press according to claim 6, including a small plate formed of elastic material provided adjacent each said sleeve, said small plates holding each said sleeve in each said bore.

* * * * *